US005146278A

United States Patent [19]

Kroll et al.

[11] Patent Number: 5,146,278

[45] Date of Patent: Sep. 8, 1992

[54] APPARATUS FOR APPLYING TONER TO AN ELECTROSTATIC IMAGE

[75] Inventors: Arthur S. Kroll, Rochester; Michael L. DeCecca, Fairport; Arthur E. Dunn, Rochester, all of N.Y.

[73] Assignee: Eastman Kodak Company, Rochester, N.Y.

[21] Appl. No.: 669,702

[22] Filed: Mar. 15, 1991

[51] Int. Cl.[5] ..... G03G 15/09

[52] U.S. Cl. ..... 355/253; 355/200; 355/245; 355/327

[58] Field of Search ..... 355/200, 210, 245, 326, 355/327, 251, 253, 260, 259; 118/656, 657, 661

[56] References Cited

U.S. PATENT DOCUMENTS 4,378,753 4/1983 Ueno et al. ..... 118/657
4,622,916 11/1986 Tanaka et al. .
4,699,494 10/1987 Honda .
4,797,704 1/1989 Hill et al. .
4,801,966 1/1989 Ikeda .
4,884,109 11/1989 Hill et al. .
4,891,672 1/1990 Takagi .
4,922,302 5/1990 Hill et al. .
4,928,146 5/1990 Yamada .
4,998,145 3/1991 Haneda et al. ..... 355/327
5,053,820 10/1991 Preszler et al. ..... 355/245
5,065,192 11/1991 Adkins et al. ..... 355/251

*Primary Examiner*—A. T. Grimley
*Assistant Examiner*—Sandra L. Brasé
*Attorney, Agent, or Firm*—Leonard W. Treash

[57] ABSTRACT

An applicator of a developing portion of an image-forming apparatus is permanently located with respect to an image member. A plurality of developing units are separately positionable with respect to said applicator for supplying developer to the applicator. Each of said development units can contain toner of different colors. The applicator and image member can be part of a cartridge which is separately loadable into the image-forming apparatus.

17 Claims, 4 Drawing Sheets

APPARATUS FOR APPLYING TONER TO AN ELECTROSTATIC IMAGE

FIELD OF THE INVENTION

This invention relates to the development of electrostatic images. It is particularly useful in applying toner of different colors to different electrostatic images.

BACKGROUND ART

A number of references show developing units which are movable into position with respect to an image member as part of the operation of the machine. For example, U.S. Pat. No. 4,928,146 shows apparatus in which four linearly arranged development stations are sequentially moved to a single development position to apply different color toner to four consecutive electrostatic images. U.S. Pat. No. 4,622,916 shows four toner stations on a rotary carriage which rotates the stations through a single development position to also apply different color toner to four consecutive images. U.S. Pat. No. 4,801,966 is typical of a large number of references showing toning stations that are movable in and out of their own unique developer position to apply the correct color toner to the image being toned. U.S. Pat. No. 4,891,672 shows a system in which one of a group of color stations is moved into a single toning position for a series of reproductions and then is replaced on demand from a storage position by another toning station of different color for another series of reproductions.

In most of these apparatus, a drum photoconductor is permanently fixed in the apparatus as is the supporting structure for each development unit. With such structure, critical positioning of each development unit with respect to the photoconductive drum can be managed by precise manufacturing and assembly of those parts and their supporting structure. It would be desirable to remove the need for such precision.

U.S Pat. Nos. 4,922,302 issued to Hill et al on May 1, 1990; 4,884,109 issued to Hill et al on Nov. 28, 1989 and 4,797,704 issued to Hill et al on Jan. 10, 1989; show a development station having an applicator with a rotating magnetic core and a stationary non-magnetic sleeve around which a developer mixture is moved by rotation of the core to pass the developer through a development position. The applicator is fed by a rotating paddle positioned below the applicator which both mixes developer and supplies it to the applicator. This particular structure requires that the applicator not be in contact with the image member carrying an electrostatic image to be developed, that it be precisely spaced from it.

In those structures in which a plurality of development stations can be alternatively positioned at a single development position with respect to a drum or other image member, precise positioning of the applicator of those development units is very challenging. In instances in which the applicator is positioned by a pair of rollers on either end of the applicator which mates with the image member, not only must the rollers be positioned and sized accurately, but the applicator must also be parallel to the axis of rotation of the image member. Further, if the applicator is flat on top as in the Hill et al disclosures above, the applicator itself must not be rotated about its axis or its separation from the photoconductor will be affected.

U.S. Pat. No. 4,699,494, Honda, issued Oct. 13, 1987 is typical of a number of references which show a cartridge including a photoconductive drum and a development station which is separately loadable into an image-forming apparatus. Suitable drives in the image-forming apparatus mate with comparable drives in the cartridge to both rotate the photoconductive drum and a development applicator. This structure has the advantage that the development applicator is positioned accurately with respect to the drum during manufacture of the cartridge. However, a cartridge is not ordinarily large enough to hold 3 or 4 toning stations for making multicolor images.

DISCLOSURE OF THE INVENTION

It is an object of the invention to provide an image-forming apparatus in which more than one developing unit can be positioned to develop an electrostatic image at a single development position, but without the positioning problems associated with separately positioning the applicator of a development unit with respect to the image member.

It is another object of the invention to provide a cartridge which includes an image member which cartridge can be accessed by a plurality of development units at a single position also without the above-mentioned positioning problems.

This and other objects are accomplished by an image-forming apparatus in which a plurality of development units are movable one at a time into operative relation with an image member. A single applicator is precisely positioned permanently with respect to said image member. The development units include the means other than the applicator necessary to develop electrostatic images and to interface with the permanent applicator when they are brought into their operative position.

With this structure the critical positioning between the applicator and the image member is permanently fixed during manufacture or mounting of the image member. Interface between the applicator and each of the plurality of development units is much less critical and is easily accomplished repeatedly in the image-forming apparatus.

According to a preferred embodiment, the image member is contained in a cartridge for easy loading in the apparatus and the applicator is a permanent part of the cartridge. It is mounted precisely with respect to the image member during manufacture of the cartridge.

BRIEF DESCRIPTION OF THE DRAWINGS

In the detailed description of the preferred embodiment of the invention presented below, reference is made to the accompanying drawings, in which.

BEST MODE OF CARRYING OUT THE INVENTION

Figure 1:
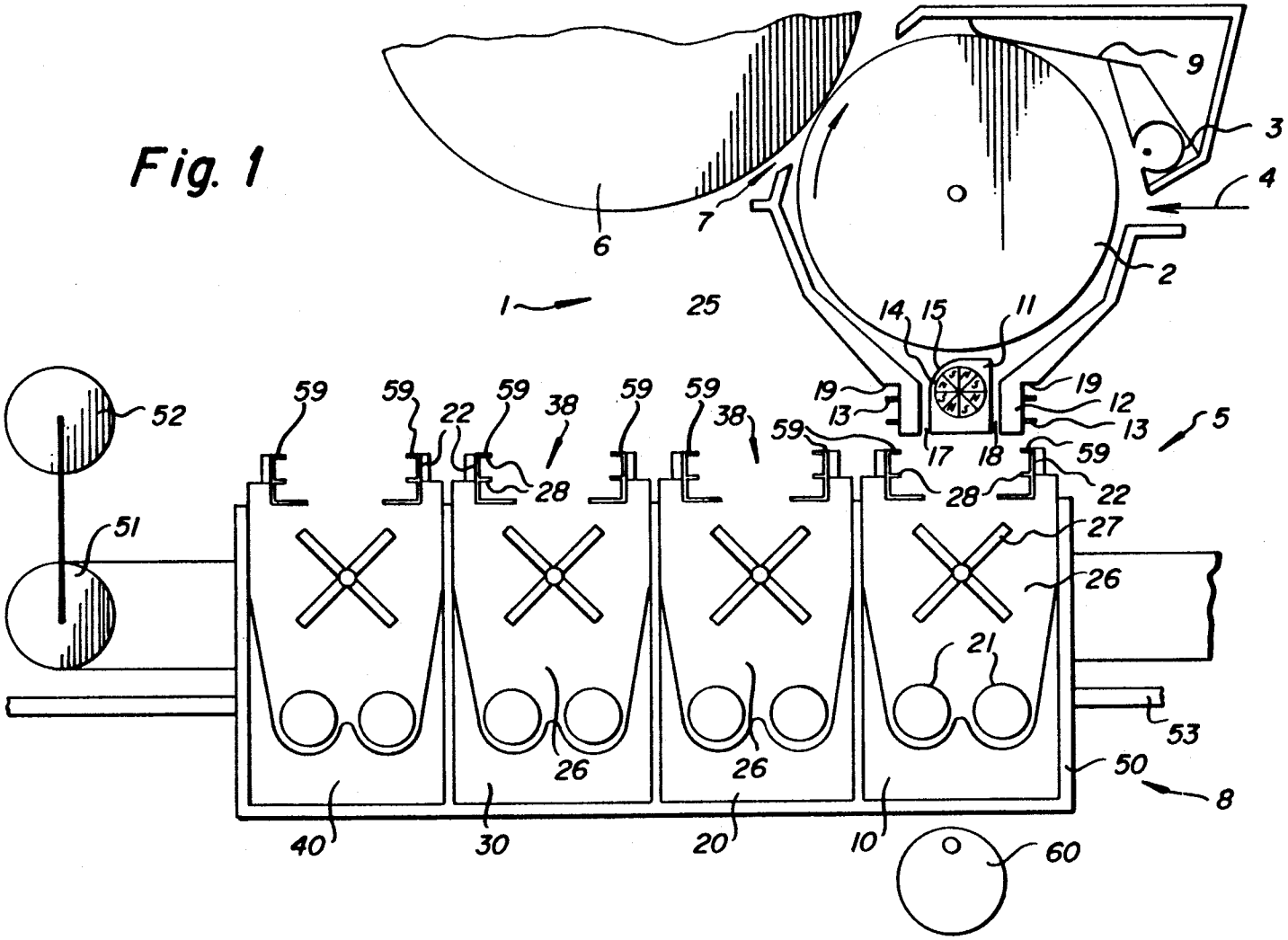
FIG. 1 is a front schematic of an image-forming apparatus constructed according to the invention.
Figure 3:
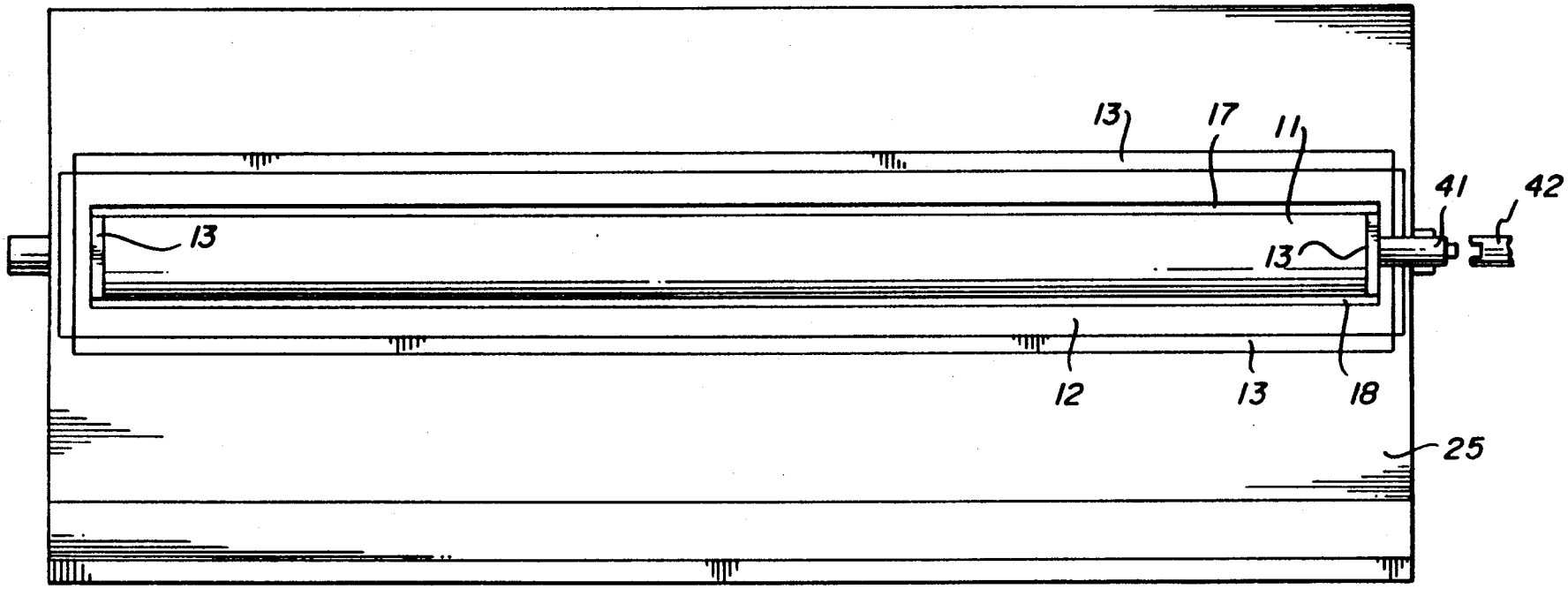
FIG. 3 is a bottom view of a cartridge containing an image member and a portion of the development apparatus which cartridge is also a part of the image-forming apparatus shown in FIG. 1.

According to FIG. 1, an image-forming apparatus, for example, printer 1 includes an image member, for example, a photoconductive drum 2, which image member has been positioned in printer 1 as part of a cartridge 25 (see FIG. 3). Printers receiving cartridges containing photoconductive drums and at least some of the electrophotographic stations which cooperate with the drum to form transferable toner images have been used commercially for a number of years. Typical of such cartridges, cartridge 25, includes a charging station 3 for uniformly charging the surface of photoconductive drum 2, and an exposure opening 4 through which uniformly charged drum 2 can be imagewise exposed to form a series of electrostatic images. Unlike the prior art, the electrostatic images are toned with toners of different colors by a development device 5 which includes portions both in the cartridge and in the rest of the image-forming apparatus.

The series of different color toner images are transferred in registration to a surface associated with a transfer drum 6. The surface may be the outside surface of transfer drum 6 or a receiving sheet carried by that outside surface. In either instance, the transfer drum 6 is rotated through transfer station 7 repeatedly to receive the toner images superposed in registration to form a multicolor image. If the images are transferred directly to the surface of transfer drum 6, a receiving sheet is fed to drum 6 at a position (not shown) remote from drum 2 for receipt of the multicolor image in a single transfer step. If the receiving sheet is attached to drum 6, the receiving sheet is separated from drum 6 also at a position remote from photoconductive drum 2 and not shown. In each instance, the sheet is fed to a fuser for fixing and hence fed out of the printer 1, all as is conventional in the art. Also, conventionally, the photoconductive drum 2 is cleaned at a cleaning station 9 within the cartridge 25 for reuse.

Typically, photoconductive drum 2 is quite small, for example, 5 inches in diameter. For single color imaging, it is convenient to put a single development station including its toner supply totally within the cartridge housing. The entire cartridge is then replaced when the supply of toner is exhausted. However, photoconductive drum 2 may last 10 to 20 times as long as a convenient supply of toner. It thus may be desirable even in a single color apparatus to separate the supply of toner from the cartridge carrying the photoconductive drum.

More importantly, in three or four color imaging, it is impractical to include three or four complete development systems around a small photoconductive drum in a single cartridge.

Thus, it is desirable to separate the development portion of the apparatus from the photoconductive drum cartridge, especially in a color image-forming apparatus. However, most types of electrostatic development apparatus require accurate positioning between an applicator and the image member. Maintenance of accurate spacing (or an accurate band of contact in contact systems) between the applicator and the image member when the image member is loadable in an apparatus as part of a cartridge and the applicator is a permanent part of the apparatus is challenging. If three or four different toners are to be applied at a single position around the periphery of the image member, requiring changing development stations several times during a single multicolor image formation, that challenge is even more difficult.

According to FIG. 1, applicants have solved this problem by positioning an applicator 11 as a permanent part of cartridge 25. Although applicator 11 could be of a number of different types, the invention is particularly useful with a developing device similar to that shown in U.S. Pat. No. 4,922,302 to Hill et al, cited above, which patent is incorporated by reference herein. More specifically, applicator 11 includes a stationary shell 15 and a rotatable core 14. As seen in FIG. 3, applicator 11 includes a shaft 41 which mates with a drive shaft 42 in the printer 1 for rotating the magnetic core 14 (FIG. 1).

Applicator 11 is held by an applicator mount 12 which mount provides spacings 17 and 18 on either side of applicator 11 between the outside of the cartridge and the image member 2. The cartridge 25 adjacent the mount 12 includes a housing defining positioning surfaces 19 facing generally downward as shown in FIG. 1. The outside surfaces of mount 12 include flaps 13 which perform the functions of baffles. They are made out of a typical baffle material, for example rubber and are flexible.

The rest of development station 5 includes a developer supply module 8 which includes a movable carriage 50 which supports separably movable development units 10, 20, 30 and 40. Each of development units 10, 20, 30 and 40 includes a developer having a color toner different from each other unit. Preferably, the developer is of a two-component type which includes hard, magnetic carrier particles having high coercivity making them readily transported by rotation of core 14.

Each of the development units 10, 20, 30 and 40 includes a mixing and transporting structure including a rotatable paddle 27 and rotatable augers 21 in a development chamber 26. Developer is contained in development chamber 26 up to a level covering a portion of the paddle but not substantially above the paddle. At the top of chamber 26 is an opening 38. Opening 38 is defined by a baffle wall 22 which surrounds opening 38 and includes rubber flaps 28.

Figure 2:
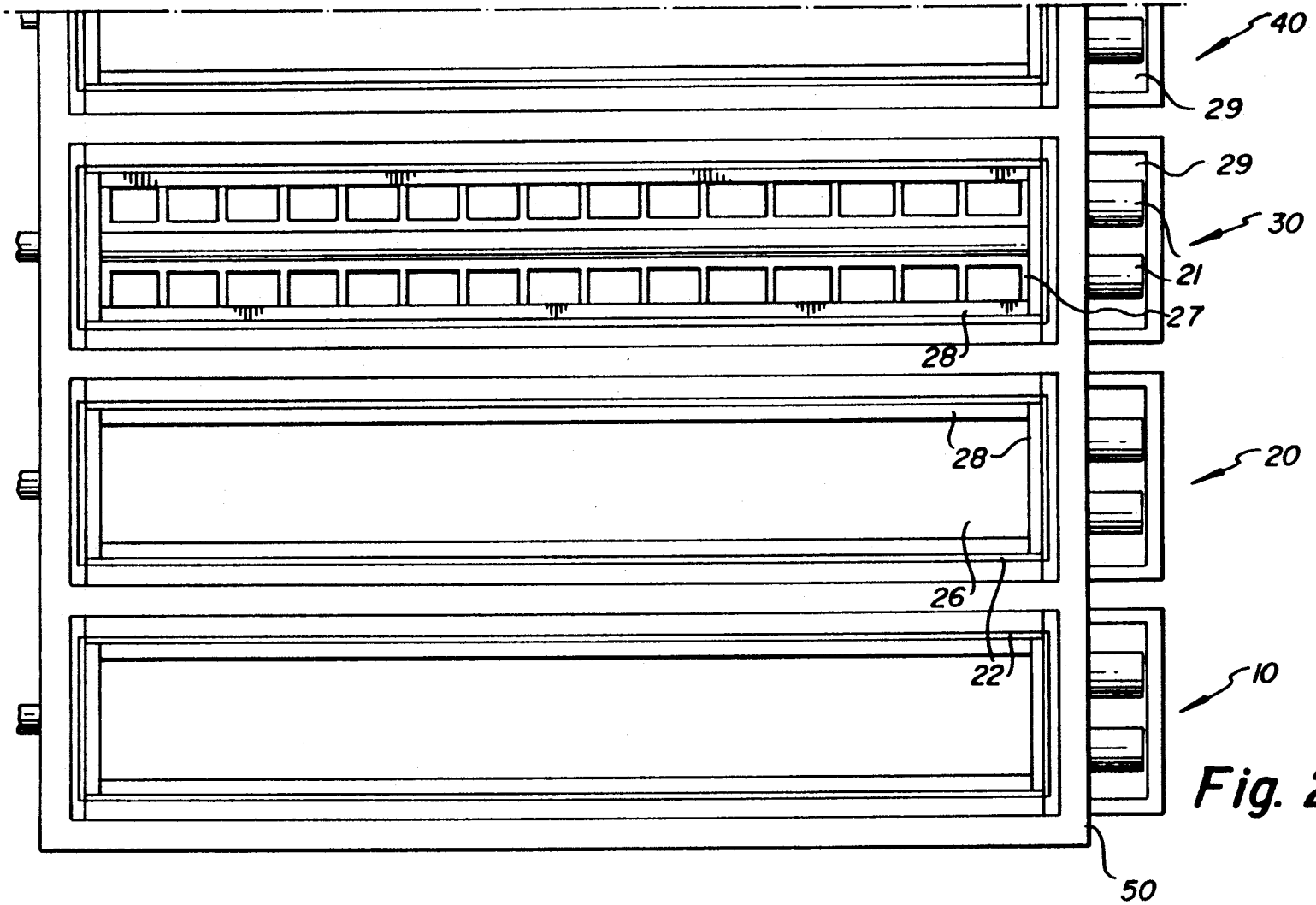
FIG. 2 is a top view of a portion of the developing part of the image-forming apparatus shown in FIG. 1.

Carriage 50 is moved laterally by a belt carriage drive 51, powered by a motor 52, to position each development unit sequentially in alignment with applicator 11. Paddles 27 are driven through shafts 35 shown in FIG. 2 which shafts are connectable through drive trains to one or four motors which motors are movable with carriage 50 and are not shown. Because units 10, 20, 30 and 40 are each movable with respect to carriage 50 and each other, it is preferable that a separate motor be used for each unit which also makes the unit separately actuatable without a clutching mechanism. Augers 21 are geared internally in the units to paddles 27 by means not shown.

Figure 4:
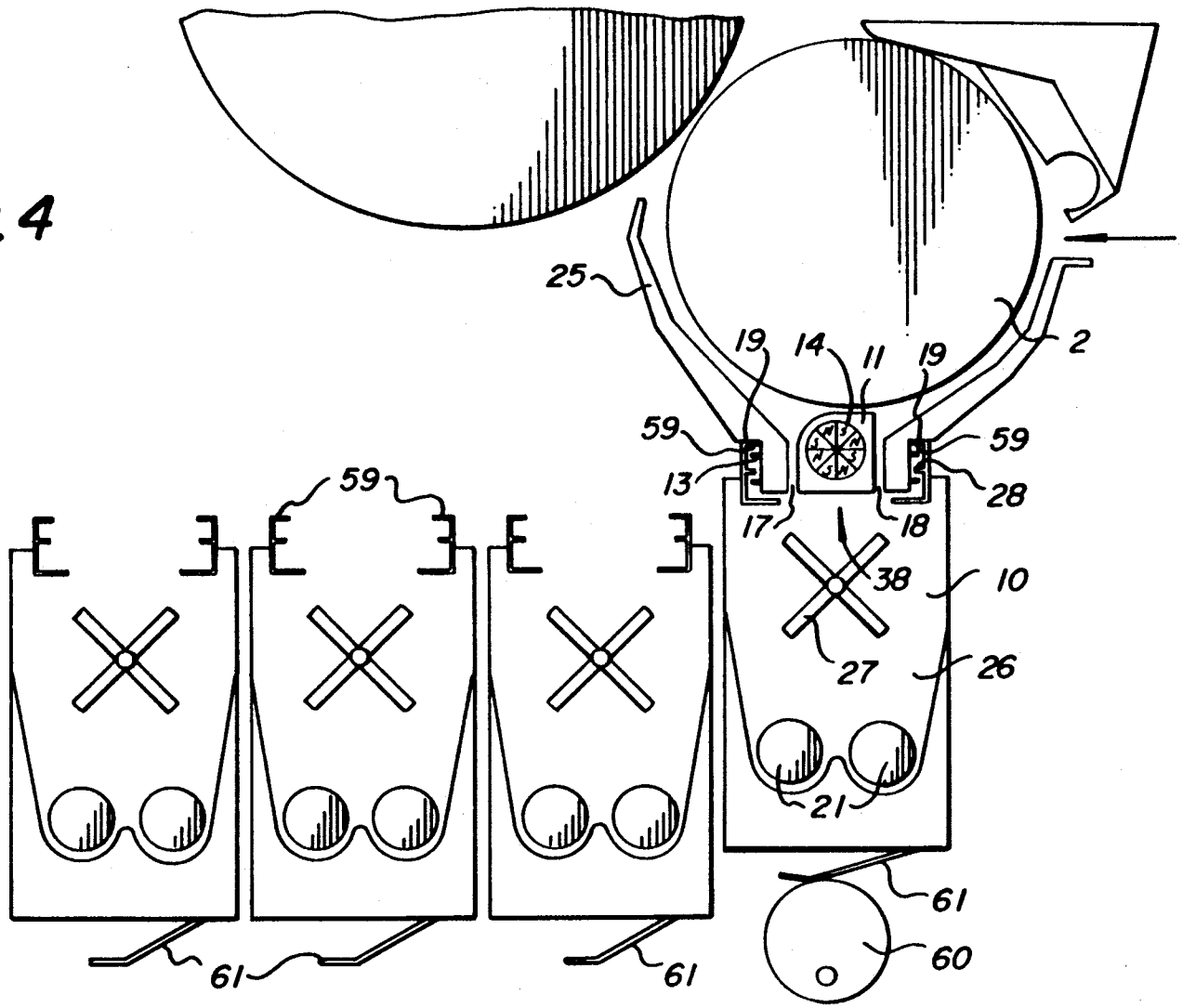
FIG. 4 is a front schematic similar to FIG. 1 illustrating the development portion of the image-forming apparatus in its operative position.

In operation, each of the developing units 10, 20, 30 and 40 is separately aligned, one at a time, with applicator 11 according to the desired color on the electrostatic image passing applicator 11. As shown in FIG. 4, to develop the image passing applicator 11, a cam 60 is rotated to engage a strong cantilever spring 61 which, in turn, urges aligned development unit 10 in an upward direction. Unit 10 moves in an upward direction until top surfaces 59 of baffle extension members 22 engage positioning surfaces 19 on cartridge 25. Rubber flaps 13 on applicator mount 12 interleave with rubber flaps 28 on the inside of opening 38 to provide a seal preventing the escape of toner.

Rotation of paddle 27 and augers 21 in station 10 is commenced once unit 10 is seated on positioning surfaces 19. This raises the level of developer in chamber 26, essentially throwing it against the bottom of applicator 11. Core 14 of applicator 11 is rotated rapidly moving developer in one of opening 17 and 18 and out the other. The developer is tumbled through a small but precise spacing between applicator 11 and drum 2 developing the electrostatic image as more fully described in the Hill et al patents referred to above, which patents are incorporated by reference herein.

After the image has been toned, the paddle 27 is stopped while core 14 is continued to be driven, removing all developer from applicator 11. Core 14 is then stopped. Cam 60 is rotated to its position shown in FIG. 1 and unit 10 lowers to its position shown in FIG. 1. This lowering can be accomplished completely by gravity. However, it is preferable to have a spring, not shown, weaker than spring 61 urging development unit 10 to its lower position.

At this point, motor 52 is actuated to move carriage 50 to align development unit 20 (or another development unit) with applicator 11 for toning the next image. The applicator 11 having been cleaned by rotation of its core after paddle 27 has ceased to rotate, a developer containing a color toner different from that in development unit 10 can be applied by the same applicator 11.

A new supply of toner to units 10, 20, 30 and 40 is accomplished by a gravity feed to extensions 29 (FIG. 2) from toner supply devices positioned over extensions 29 which devices are moved with carriage 50 and are not shown.

The invention has particular utility with an image member 2 carried in a cartridge 25, which cartridge also includes an applicator 11 precisely positioned with respect to that image member. However, the invention can also be used with an applicator and image member which are more permanent parts of an image-forming apparatus. In this instance, applicator 11 is made as a permanent part of the apparatus while the image member itself is precisely replaceable by a service person with respect to it. Because a plurality of development units 10, 20, 30 and 40 would still be separately, operatively positioned with respect to applicator 11 during each multicolor image-forming cycle, the accurate positioning of the permanent applicator still offers advantages. The relative positioning of the paddle 27 and the chamber 26 with respect to the applicator 11 is considerably less critical than is the spacing or other relation (for example, light contact) between the applicator 11 and the image member 2.

Note also that a portion of the applicator 11, for example, core 14, could be a permanent part of the apparatus while the rest of the applicator, including the sleeve 15, is part of the cartridge and again positioned accurately with respect to drum 2. In this instance, insertion of the cartridge in the apparatus would involve insertion of the core 14 in applicator 11. This structure would have the advantage of the more expensive core and its drive being a permanent part of the apparatus while a less expensive sleeve is replaced each time with the cartridge. The sleeve, of course, is a critical element to be accurately spaced with respect to image member 2. This structure would also not require a separable coupling for the shaft of the core in the cartridge, as shown in FIG. 3.

Although this invention has great utility with the structure shown, applicators of other design than that shown can be used. For example, the core 14 can be stationary and a cylindrical sleeve rotatable to move developer through a development position. It is also known to rotate both core and sleeve. A single component non-magnetic or magnetic toner system can also be used in which the applicator makes light contact (or is just out of contact) with the drum and is loaded with developer by structure in units 10, 20, 30 and 40.

The invention has been described in detail with particular reference to a preferred embodiment thereof, but it will be understood that variations and modifications can be effected within the spirit and scope of the invention as described hereinabove and as defined in the appended claims.

We claim:

1. An image-forming apparatus including:

an image member, a developer applicator permanently mounted with respect to said image member, said applicator having means for moving developer into developing relation with said image member, and a plurality of development units, each of said units being movable one at a time into operative relation with said applicator from a position out of operative relation with said applicator, and each of said units including a developer including at least a toner of a color different from the toner of the other units and each of said units including means for supplying said developer to said applicator when said unit is in operative relation with said applicator.

2. An image-forming apparatus according to claim 1 wherein said applicator includes a magnetic core and a non-magnetic shell at least one of which is rotatable to bring developer from a development unit which unit is in operative relation with said applicator, into developing relation with said image member.

3. An image-forming apparatus according to claim 2 wherein said apparatus includes a stationary shell and a rotatable core within said shell for moving developer having a magnetic component around said shell.

4. An image-forming apparatus according to claim 3 wherein said shell is slightly spaced from said image member.

5. An image-forming apparatus according to claim 2 wherein said shell is slightly spaced from said image member.

6. An image-forming apparatus according to claim 1 wherein at least one of said applicator and development unit include baffle means for interfacing with the other of said applicator and development unit to prevent developer from escaping between said unit and applicator during operation.

7. The image-forming apparatus according to claim 1 wherein said image member and said applicator are both part of a single cartridge, which cartridge is loaded as a unit into said image-forming apparatus.

8. An image-forming apparatus according to claim 7 further including a single movable carriage, each of said development units being mounted on said carriage for movement into alignment with said applicator.

9. An image-forming apparatus according to claim 8 further including means for moving an aligned development unit into operative relation with said applicator by moving said development unit relative to said carriage and relative to the other development units.

10. An image-forming apparatus according to claim 1 further including a single movable carriage, each of said development units being mounted on said carriage for movement by said carriage into alignment with said applicator.

11. An image-forming apparatus according to claim 8 further including means for moving an aligned development unit into operative relation with said applicator by moving said development unit relative to said carriage and relative to said other units and towards said applicator.

12. A cartridge for insertion in an image-forming apparatus which image-forming apparatus includes a plurality of development units, each development unit including a chamber having a supply of developer, an opening from said chamber and means for supplying developer to said opening, said cartridge comprising:

a rotatable image member, an applicator sized and positioned to fit into an opening in a chamber of a development unit, said applicator including means defining a surface over which or on which developer is movable from said chamber through developing relation with said image member.

13. A cartridge according to claim 12 wherein said applicator further includes rotatable means for moving said developer along said surface through said developing relation with said image member.

14. A cartridge according to claim 12 further including positioning surfaces for mating with a development unit which development unit has been moved into operative relation with said applicator.

15. A cartridge according to claim 12 including a housing for said applicator, which housing includes baffle means for cooperating with a development unit to prevent the escape of developer between said developing unit and said applicator housing.

16. A cartridge loadable in an image-forming apparatus, said cartridge including:

a rotatable photoconductive drum, a magnetic applicator having a rotatable member for moving developer having a magnetic component into developing relation with said drum, and mounting means for permanently positioning said applicator in developer applying relation to said drum, said applicator and mounting means defining openings on either side of said applicator for moving developer toward and away from said drum from outside said cartridge.

17. A cartridge according to claim 16 further including means associated with said mounting means for engaging a development unit and for accurately positioning said development unit with respect to said applicator.

* * * * *